US005240326A

United States Patent [19]

Evanson

[11] Patent Number: 5,240,326

[45] Date of Patent: Aug. 31, 1993

[54] CHEMICAL HANDLING AND MIXING SYSTEM

[75] Inventor: Mark A. Evanson, Phoenix, Ariz.

[73] Assignee: Environmental Consideration, Ltd., Litchfield Park, Ariz.

[21] Appl. No.: 635,268

[22] Filed: Dec. 28, 1990

[51] Int. Cl.[5] ..... B01F 13/06; B01F 5/04; B01F 5/20

[52] U.S. Cl. ..... 366/139; 366/167; 366/174; 366/194; 422/278

[58] Field of Search ..... 366/139, 150, 154, 167, 366/173, 174, 177, 181, 182, 183, 336, 337, 340, 13, 341, 91, 96, 101, 107, 165, 169, 171, 178, 204, 226, 228, 230, 231; 422/264, 275, 278, 269, 263, 277; 134/93; 68/17 R; 137/268; 99/306, 307

[56] References Cited

U.S. PATENT DOCUMENTS

| | | | |
|---|---|---|---|
| 1,376,287 | 4/1921 | Meyfarth | 99/307 |
| 1,386,809 | 8/1921 | Taylor . | |
| 1,695,354 | 12/1928 | Thomason . | |
| 2,178,735 | 11/1939 | Behrman | 299/84 |
| 2,621,156 | 12/1952 | Farrell | 210/1 |
| 3,348,738 | 10/1967 | Hertlein | 222/88 |
| 3,965,975 | 6/1976 | Edmundson | 165/108 |
| 3,966,175 | 6/1976 | Stock et al. | 259/8 |
| 4,199,262 | 4/1980 | Cribb et al. | 366/44 |
| 4,347,224 | 8/1982 | Beckert | 422/278 |
| 4,448,535 | 5/1984 | West | 366/13 |
| 4,498,986 | 2/1985 | Temme et al. | 210/199 |
| 4,535,933 | 8/1985 | Kuiper | 237/12.3 |
| 4,638,926 | 1/1987 | Brock | 222/82 |
| 4,816,222 | 3/1989 | Fagrell | 422/275 |
| 5,009,848 | 4/1991 | Secretarski | 137/268 |

*Primary Examiner*—Harvey C. Hornsby
*Assistant Examiner*—Randall E. Chin
*Attorney, Agent, or Firm*—Rosenbaum & Schwartz

[57] ABSTRACT

A chemical handling and mixing apparatus is disclosed, consisting of a chemical loading apparatus in which bulk chemical is mixed with water into an aqueous solution or slurry and an agitation apparatus which receives the aqueous solution or slurry from the chemical loading apparatus and further mixes the solution or slurry to ensure even mixing and delivers the mixed chemical to a pump for storage or use.

4 Claims, 4 Drawing Sheets

CHEMICAL HANDLING AND MIXING SYSTEM

BACKGROUND OF THE INVENTION

The present invention relates generally to chemical handling and mixing systems consisting generally of a mixing chamber in which bulk chemicals may be mixed into aqueous slurries of aqueous solutions and agitated to ensure proper mixing. More specifically, the present invention consists of a chemical loading apparatus in which bulk chemical is mixed with water into an aqueous solution or slurry, and an agitation apparatus which receives the aqueous solution or slurry from the chemical loading apparatus and further mixes the solution or slurry to ensure even mixing and delivers the mixed chemical to a pump for storage or use.

DESCRIPTION OF THE PRIOR ART

The use of wettable spray powders and bulk liquid chemicals in many areas of agriculture has become routine and widespread. Various chemicals, such as herbicides, insecticides and fungicides are packaged in paper bags or plastic containers of a variety of sizes and volumes. Each type of bulk chemical requires the operator to open the container, empty the bulk chemical contents into a spray tank, add a mixing fluid, usually water, and stir or agitate the mixture to produce a suspension or aqueous solution capable of being sprayed or delivered to a desired area.

Due in large part to the toxic effects of repeated exposure to the bulk chemical, minimizing the operator's exposure to the bulk chemical is a desired feature of any chemical handling and mixing system. Accordingly, a number of inventions have been devised to facilitate mixing of bulk chemicals with a fluid while minimizing exposure to the chemical.

For example, U.S. Pat. No. 4,638,926, entitled "WETTABLE SPRAY BOX", issued Jan. 27, 1987, discloses a spray box for dispensing agricultural spray powders into a spray equipment tank to protect the operator from exposure to the powder. The box consists of a tank having a main pipe extending downwardly into a spray tank. A fill pipe extends into the interior of the main pipe and is connected to a water source. A knife is positioned within the box to slit a bag of powder which is inserted into the box. A screen is provided to prevent the bag from falling in the bottom of the box. The unopened bag of spray material is inserted into the box, the box is closed, the knife splits open the bag, and water is supplied to the mixing pipe which mixes the powder and causes the mixed powder to flow into the spray tank. The principal disadvantage of this invention is its limited chemical handling capacity and the need for agitation of the spray tank after the mixed chemical is introduced through the spray box.

Larger chemical mixing tanks have been devised to facilitate mixing of large volumes of bulk chemicals. U.S. Pat. No. 1,386,809, entitled "AGITATOR," issued Aug. 9, 1921, discloses a mixing tank for extracting gold or silver from crushed ore. In that patent there is disclosed a tank, into which a cyanide and crushed ore solution are mixed, having a conical bottom and a discharge opening which communicates into a pair of return pipes which return the discharged solution to spray heads provided above the surface of the liquid in the tank. Two air jet pipes act as inspirator jets, and conduct compressed air from an air pipe into the return pipes, thereby driving a flow of liquid up the return pipes to the spray heads. A valve in the discharge opening must be closed to seal the discharge opening and activate the air jets to function in the aforementioned manner.

U.S. Pat. No. 1,695,354, entitled "BOILER COMPOUND DISSOLVER," issued Dec. 18, 1928, discloses a system for treating a water supply to a boiler by dissolving soda ash and other boiler compounds, in the supplied water, to prevent the introduction of impure water into the boiler. The system consists principally of a fluid tank having a lower funnel-shaped or conical bottom portion and a series of wire mesh screens horizontally provided above the funnel-shaped lower portion. A spray pipe extends into the interior of the chamber and communicates with the external water supply. The spray pipe conducts water into the interior chamber in order to introduce it into the chamber for subsequent treatment within the chamber.

U.S. Pat. No. 2,621,156, entitled "METHOD FOR FEEDING FILTER AID," issued Dec. 9, 1952, discloses a tank adapted to support a filter powder in an elevated position on a screen grid, which facilitates mixing of the filter powder with turbulent water underneath the screen grid. The filter material is disposed inside a chamber defined by the upper portion of the tank and a screen grid which divides the upper chamber and a lower conical chamber. Fluid is introduced through an inlet and is conducted into the lower conical chamber through a central jet spray which impinges on the screen grid, thereby laterally dispersing the fluid flow which creates turbulence underneath the screen grid. The resulting turbulence results in erosion of the filter material through the screen into the liquid in the conical chamber. The fluid/filter material mixture is exhausted through an outlet port into an external flow line.

U.S. Pat. No. 3,965,975, entitled "BAFFLING ARRANGEMENTS FOR CONTACTORS," issued Jun. 29, 1976, discloses a mixing tank having an inlet and an outlet and a series of curved baffles to create turbulent eddy flows within the interior of the tank.

U.S. Pat. No. 3,966,175, entitled "APPARATUS FOR INTRODUCING PARTICULATE MATTER INTO A CONTAINER," issued Jun. 29, 1976, discloses a generally conical-shaped tank to store and release a particulate material. This patent further discloses a series of spray heads connected to a water source to wash the walls and equipment. The spray water flushes down a sloped bottom floor and into a bottom opening drain into a sump tank.

U.S. Pat. No. 4,448,535, entitled "APPARATUS FOR BLENDING ADDITIVES INTO A LIQUID," issued May 15, 1984, discloses an apparatus for blending solid additives into water. The apparatus, which may be mounted on a truck, includes an inlet line, connected to a nozzle, for introducing water into a partitioned portion of a cylindrical tank. The water flow moves in a spiral or overturning path which is known to effectuate formation of good and uniform slurries.

None of the foregoing, however, disclose a chemical handling and mixing system employing a bulk mixing tank having a continuous flow of water into the mixing chamber, which mixes the bulk chemical into a slurry or aqueous solution, an agitation tank, into which the mixed solution is delivered and later completely withdrawn, for further mixing of the chemicals, and a fume ventilation system.

SUMMARY OF THE INVENTION

Accordingly, it is a broad object of the present invention to provide a chemical handling and mixing system which employs a mixing apparatus and an agitation apparatus. In accordance with the present invention there is provided a mixing apparatus consisting of a double-walled hopper, defining a space between the inner and outer walls which is in communication with a water source, such that the entire inter-wall space is filled with a mixing fluid such as water. The inner wall of the hopper defines a mixing chamber into which chemicals are introduced and mixed with water overflowing into the mixing chamber from the space between the inner and outer walls. The hopper itself is divided into two chambers, an upper chemical introduction chamber and a lower chemical mixing chamber. The upper chemical mixing chamber is used to receive the chemicals to be mixed and conduct the chemicals to be mixed through a screen between the upper and lower chambers into the lower chemical mixing chamber. The lower mixing chamber is funnel-shaped and receives the overflowing water and the dry chemical, introduced from the upper chemical introduction chamber, and mixer both to form a slurry. The lower mixing chamber has an outlet at the lower end thereof which conducts the slurry chemical mix from the mixing chamber to the agitation apparatus.

It is desirable to provide a blade protruding upwardly from the screen to open bags or bottles of chemicals directly into the loading apparatus, a central rinse nozzle to rinse the open bags or bottles and a misting spray system provided about the upper perimeter of the loading apparatus which directs a fluid spray into the chemical introduction chamber. The misting spray system operates by syphoning fluid from the fluid flow in the inner wall space and conducting the two spray nozzles provided about the circumference of the chemical introduction chamber.

The agitation apparatus consists of a large tank which has angularly sloped floor panels which form a V-shaped tank floor. An angled baffle is vertically oriented perpendicular to the slope of the tank floor and centrally provided on the tank floor. The angled baffle serves to impart a vertically oriented eddy flow to the fluid in the tank as it traverses from an inlet located at the upper end of one of the sloped floor panels to the outlet located at the lowest point in the tank at the downward slope of the outlet side of the chamber. In this manner, an eddy flow is established in the tank and serves to mix the slurried chemical received from the mixing system and allows it to be withdrawn from the tank and stored.

It is also desirable to provide a central rinse spray nozzle associated with the angled baffle to rinse the tank periodically and a vent opening in the top of the tank.

Both the mixing apparatus and the agitation apparatus may be mounted on a truck which has a work station defined by a cage mounted on the end of the trailer bed in which the loading apparatus is provided. Associated fluid conduit and recirculation pumps are employed as necessary to supply water, conduct the slurried chemical from the mixing tank to the agitation tank and to allow the withdrawal of the mixed chemicals from the agitation apparatus.

These and other objects, features and advantages will become more apparent to those skilled in the art from the following more detailed description of the preferred embodiments of the invention taken with reference to the accompanying figures, in which like features are identified by like reference numerals.

DETAILED DESCRIPTION OF THE PREFERRED EMBODIMENTS

Figure 1:
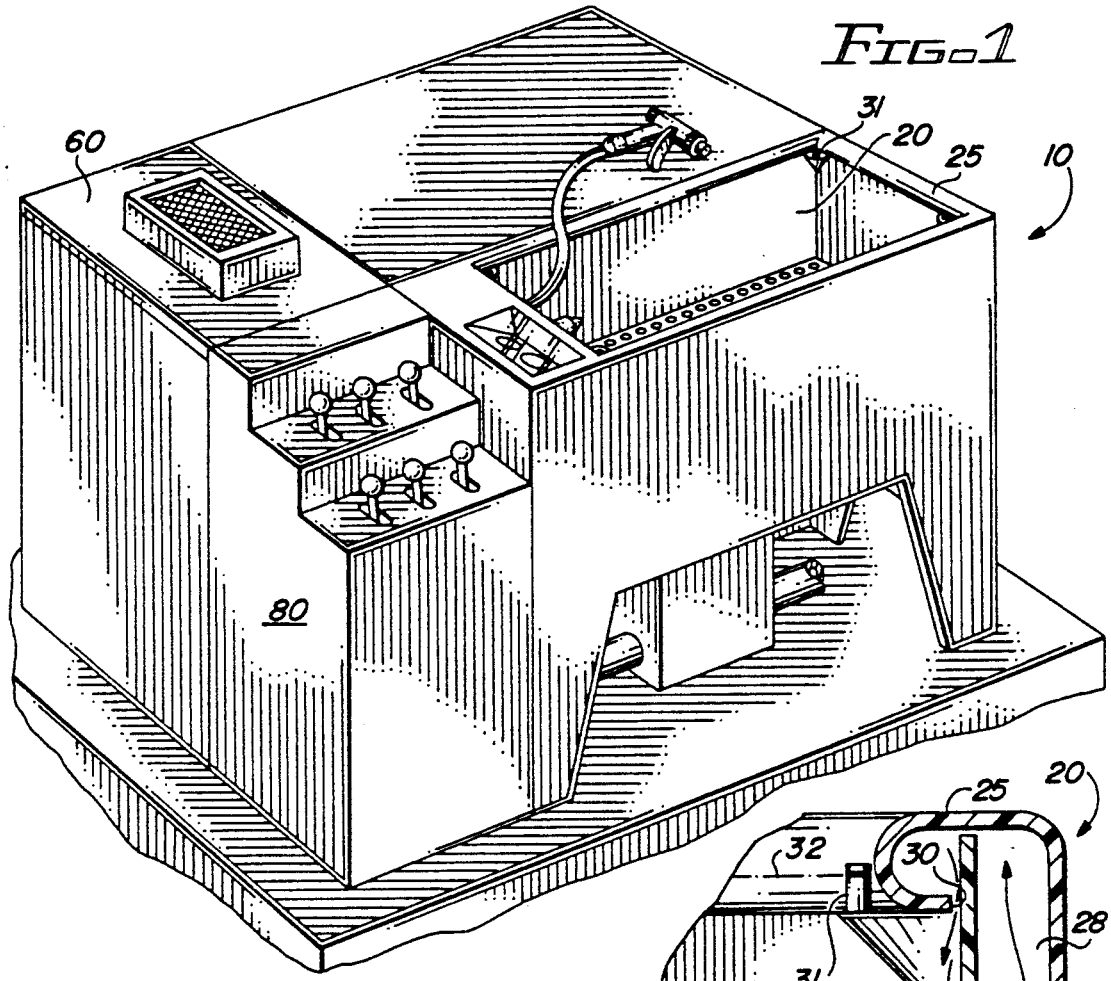
FIG. 1 is a perspective view of the chemical handling and mixing system of the present invention.
Figure 7:
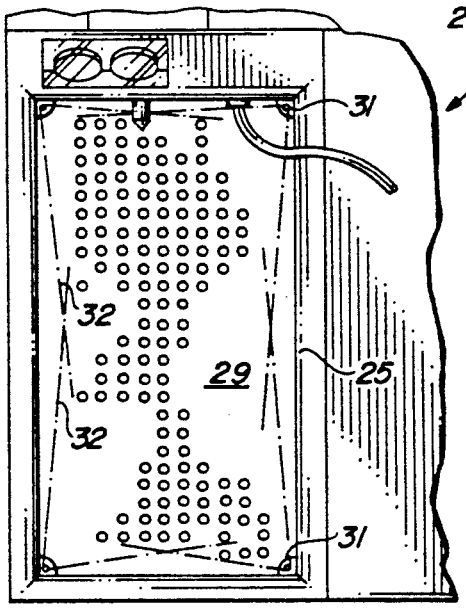
FIG. 7 is a top plan view of the chemical induction unit in accordance with the present invention.
Figure 3:
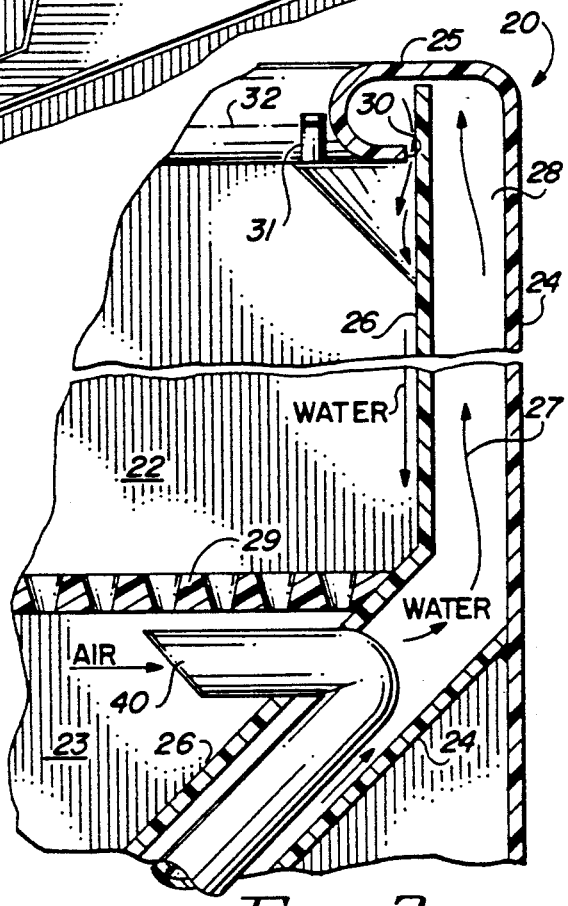
FIG. 3 is a fragmentary cross-sectional view of the chemical induction unit in accordance with the present invention.

The preferred embodiments of the invention are best illustrated with reference to the accompanying figures. FIG. 1 illustrates a contemplated construction of the chemical handling and mixing apparatus 10, hereinafter "apparatus 10", according to the present invention. Apparatus 10 consists generally of three discrete subsystems or functional units, which may be contained within a single housing or within individual housings, and which may be mounted as an operational system on a trailer or truck for portability. Specifically, there is provided a chemical induction unit 20, a chemical agitation unit 60 and a control unit 80. In accordance with one preferred embodiment of the invention, the apparatus 10 is mounted on the rear end of a water tank truck, which carries a supply of water to be used in mixing the bulk chemical and applying the mixed chemical, such as to an agricultural field.

The induction unit 20, as illustrated with reference to FIGS. 2–8, consists generally of a double walled hopper having an outer wall 24 and an inner wall 26 defining an inter-wall space 28 therebetween. Induction unit 20 is also vertically divided into two chambers, a first chamber 22 forms an upper chemical introductory portion of the induction unit 20 and a second chamber 23 forms a lower conical shaped chemical mixing portion of the induction unit 20. The second chamber 23 terminates in a drain outlet 19. A perforate plate 29, such as a mesh or screen, separates the first chamber 22 from the second chamber 23 and substantially subtends the entire chamber opening.

Figure 2:
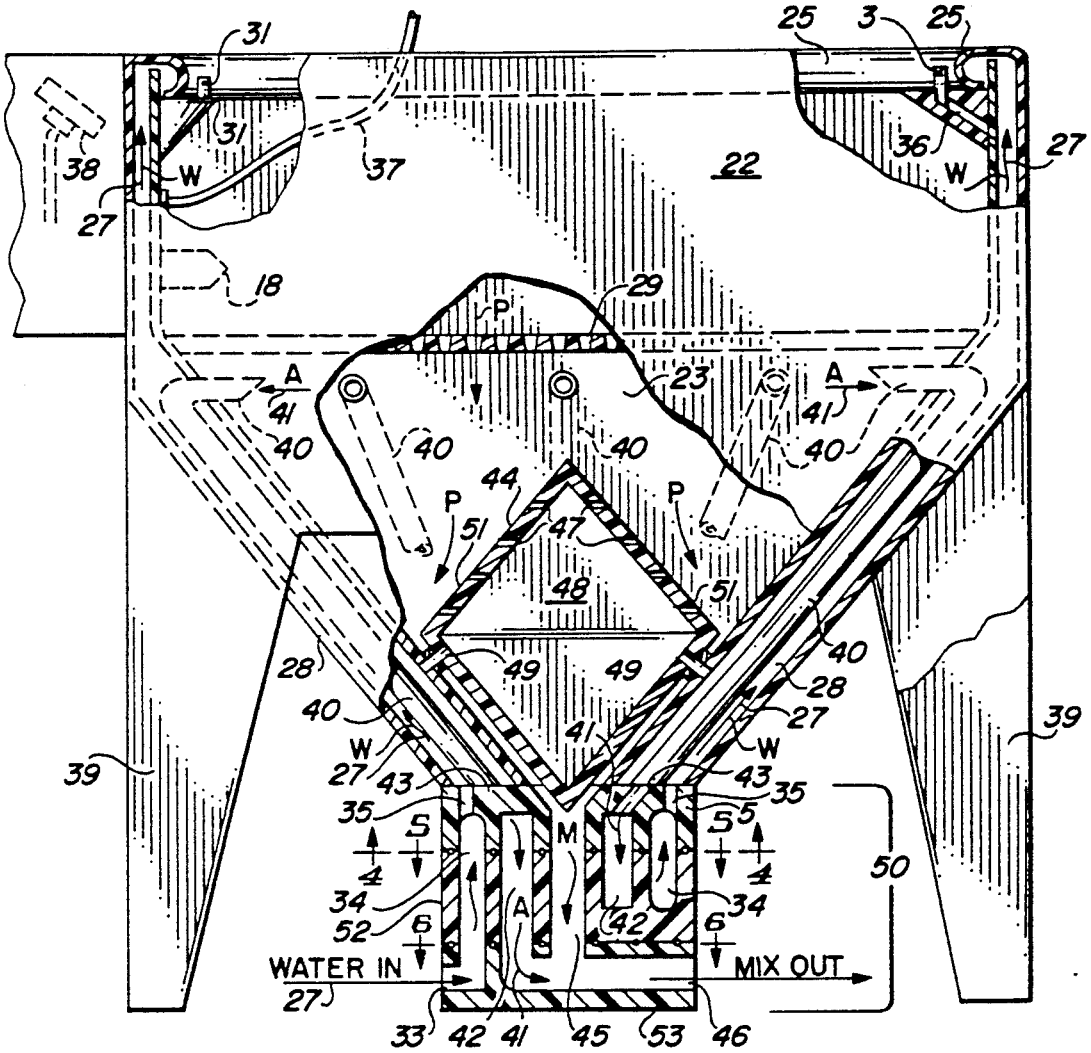
FIG. 2 is a side elevational partial cross-sectional view of a chemical induction unit of the chemical handling and mixing system of the present invention.

The first chamber 22 defines a chemical introductory chamber, while the second chamber 23 defines a mixing chamber in which the bulk chemical introduced into the first chamber 22 encounters volumes of a mixing fluid 27, such as water. The mixing fluid 27 is introduced into the first chamber 22 through the inter-wall space 28, by flowing upwardly through inter-wall space 28. As illustrated with reference to FIG. 3, outer wall 24 terminates in an upper lip 25 which encloses the inter-wall space 28 and the inner wall 26 and forms flow restriction gaps 30 between the upper lip 25 and the i 26. Restriction gaps 30 act to regulate the mixing fluid 27 and facilitate an even substantially laminar flow of the mixing fluid 27 into the upper first chamber 22 and along the interior aspect of inner wall 26. Restriction gaps 30 further maintain a fluid pressure within the inter-wall space 28, to provide a pressurized fluid source for spray nozzles 31, as shown in FIG. 2. Spray nozzles 31 are provided in the corners of the first chamber 22, and provide an initial wetting fluid to ensure that particulate chemicals introduced into the first chamber 22 do not escape from the first chamber 22. Spray nozzles 31 are in fluid flow communication with spray taps 36 communicating with the inner wall space 28.

A baffle 44, having a plurality of openings 47 passing through side walls thereof, is disposed in the second chamber 23. Baffle 44 is preferably configured as a generally hollow rectilinear structure forming an interior baffle fluid chamber 48. The baffle 44 is positioned generally co-axial within the conical shaped second chamber 23 with adjacent sides thereof positioned in a spaced and parallel relation relative to the inner hopper wall 26. At least one of a plurality of baffle fluid taps 49 support the baffle 44 in spaced relation from the inner hopper wall 26 and provide fluid flow communication between the inter-wall space 28 and the interior baffle fluid chamber 48. Baffle fluid taps 49 conduct mixing fluid 27 from the inter-wall space 28 into the baffle fluid chamber 48. Once the interior baffle fluid chamber 48 is filled with the mixing fluid 27, the mixing fluid 27 flows out of the baffle through baffle openings 47 . Baffle openings 47 are preferably configured as linear slots formed in upper side walls 51 of the baffle 44, to facilitate a sheeting or laminar flow of mixing fluid 27 out of the interior baffle fluid chamber 48 and along the upper side walls 51 of the baffle 44.

With the foregoing described configuration, chemicals introduced into the first chamber 22, will pass through the perforate plate 29 and encounter the mixing fluid 27 flowing over either the upper side walls 51 of the baffle 50, or the inner hopper walls 26.

There is also provided a plurality of chemical fume vents 40 which exhaust chemical fumes from the first introductory chamber 22 and the second mixing chamber 23. In accordance with the preferred embodiment of the invention, the fume vents 40 consist of tubular members 40 which are disposed within the inter-wall space 28 and arrayed about the circumference of the hopper. The tubular members 40 project laterally through the inner hopper wall 26 and protrude into the second mixing chamber 23. A vacuum flow 41 is pulled through tubular members 40 to evacuate fumes in the vacuum flow from the interior of the hopper.

As illustrated with reference to FIGS. 2 and 4–6, the mixing fluid flow 27 and the vacuum flow 41 are supplied to the hopper though a service block member 50 which is coupled to a lower aspect of the hopper. Service block member 50 has a plurality of internal chambers formed therein. Generally, these internal chambers consist of a mixing fluid flow chamber 34, a fume venting flow chamber 42, a mixing fluid inlet 33 in fluid flow communication with the mixing fluid flow chamber 34, a chemical mixture outlet 45 and a chemical mixture/-fume outlet 46.

According to the preferred embodiment of the invention, service block member 50 is formed from a single unitary block of malleable or formable chemically inert material, such as plastic or stainless steel. According to the preferred embodiment of the invention, service block member 50 is formed from a unitary block of polyethylene, which is vertically sectioned into three discrete block sections; upper block section 51, middle block section 52 and lower block section 53. Each of the block sections 51, 52 and 53 will have o-ring or other seals between each section, to form a fluid tight connection, and may have alignment pins and recesses or other conventional alignment devices, and conventional means for securing the block sections.

Figure 4:
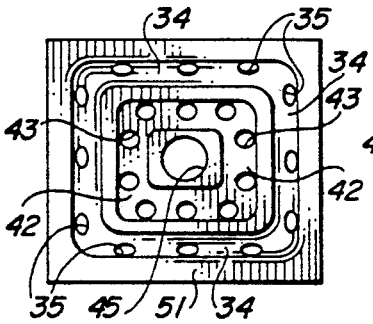
FIG. 4 is an elevational view taken along line 4—4 of FIG. 2.
Figure 5:
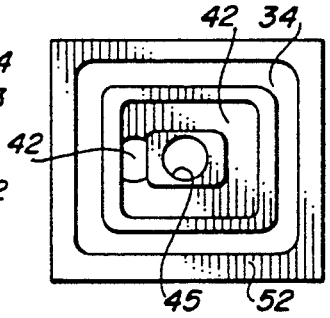
FIG. 5 is an elevational view taken along line 5—5 of FIG. 2.
Figure 6:
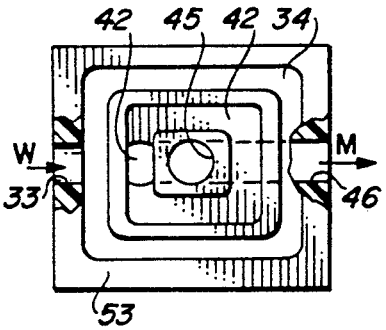
FIG. 6 is an elevational view taken along line 6—6 of FIG. 2.
Figure 8:
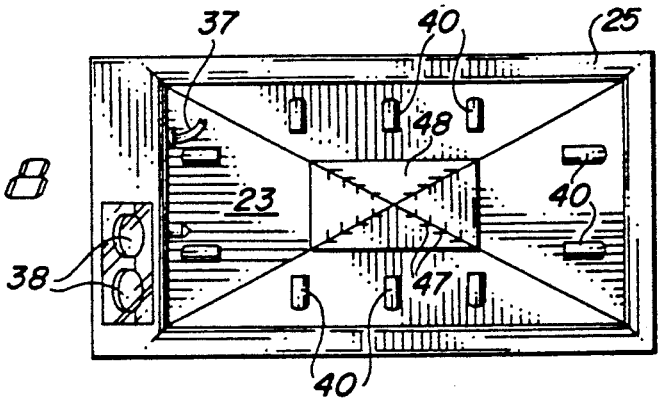
FIG. 8 is a top plan view as represented in FIG. 7, illustrating the chemical induction unit with the mixing screen removed.

With particular reference to FIGS. 4–6, there are shown upper block section 51, middle block section 52 and lower block section 53, respectively. Upper block section 51 has an upper aspect of the mixing fluid flow chamber 34 and the mixing fluid flow taps 35 communicating therewith, an upper aspect of the fume venting flow chamber 42 and the fume vent taps 43 communicating therewith, and an upper aspect of the mixture outlet port 45 formed therein. The mixing fluid flow chamber 34, fume venting flow chamber 42 and the mixture outlet port 45 are co-axially oriented, as are the mixing fluid flow taps 35 and the fume vent taps 43. The upper block section 51 is adapted to couple to a bottom aspect of the hopper, in a manner such that the mixing fluid flow taps 35 communicate with the inter-wall space 28, that the fume vent taps 43 each communicate with the fume venting conduit 40 and that the mixture outlet port 45 is in fluid flow communication with the drain outlet 19 of the hopper.

The middle block section 52 has middle sections of each of the mixing fluid flow chamber 34, fume venting flow chamber 42 and mixture outlet port 45, formed therein. Again, o-rings or other sealing means are preferably interdisposed between the upper block section 51 and the middle block section 52, during assembly of the service block member 50.

The bottom block section 53 has a lower aspect of each of the mixing fluid flow chamber 34, fume venting flow chamber 42 and mixture outlet port 45, formed therein. Additionally, however, the bottom block section 53 further has a mixing fluid inlet 33, which receives the mixing fluid flow 27 from an external source and communicates the mixing fluid flow 27 into the mixing fluid flow chamber 34. Bottom block section 53 further has a mixture/fume outlet port 46 formed therein, which communicates with both the mixture outlet port 45 and the fume venting flow chamber 42, whereby fluid exiting from the mixture outlet port 45 causes a negative air pressure in the mixture/fume outlet port 46, which, in turn creates a vacuum in the fume venting flow chamber 42 to withdraw chemical fumes from the chemical induction unit 20.

Those skilled in the art will understand and appreciate that the hopper may be of any suitable shape, i.e., circular or quadrilateral. In accordance with the illustrated embodiment of the invention, and not intended to limit the scope and content of the invention, there is shown a rectangular hopper.

In accordance with additional desirable aspects of the invention, there may be provided a rinse line 37 which taps into the inter-wall space 28, to provide a rinsing fluid source for the chemicals to be introduced into the induction unit 20. Further, there may also be provided a knife or other sharp instrument 18 projecting into the chemical mixing chamber 22 to facilitate opening and complete emptying of a bulk chemical container.

Figure 9:
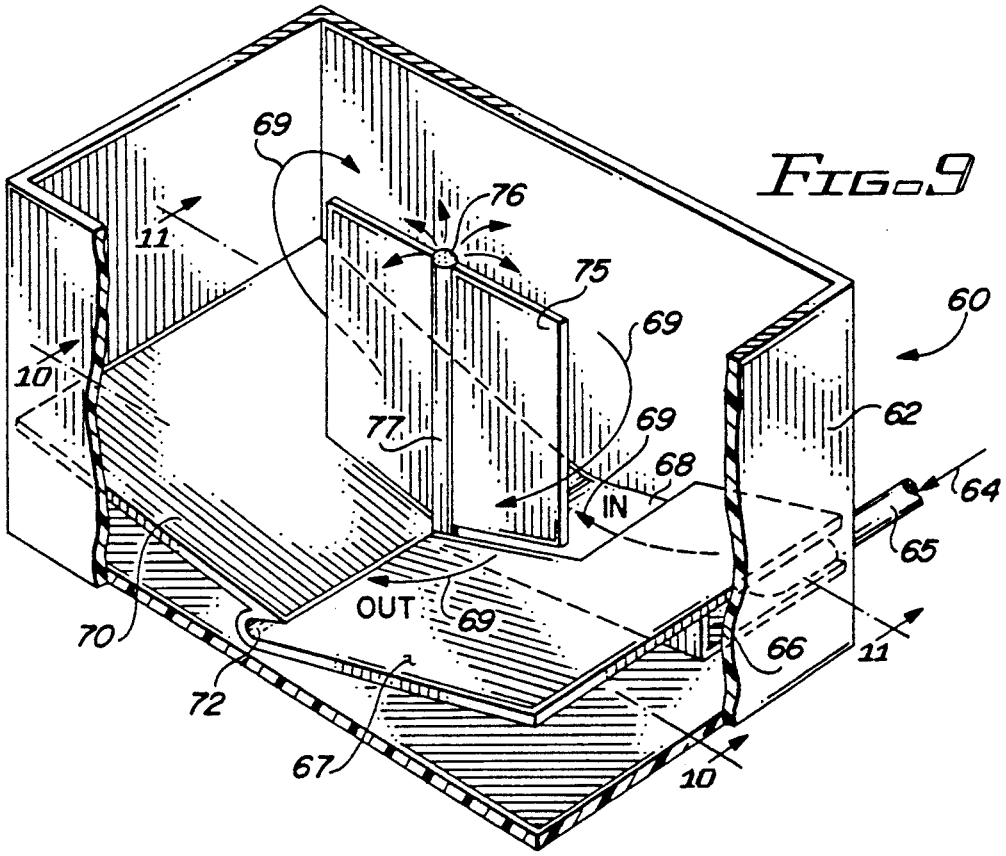
FIG. 9 is a perspective partial cut-away view of a mixing chamber unit of the chemical handling and mixing system of the present invention.
Figure 10:
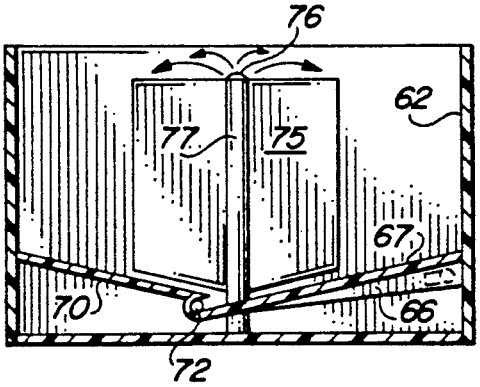
FIG. 10 is a cross-sectional view taken along line 10—10 of FIG. 9.
Figure 11:
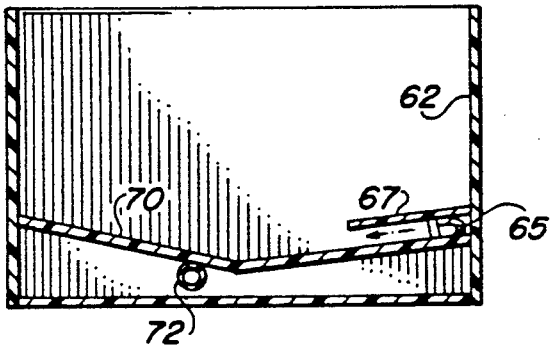
FIG. 11 is a cross-sectional view taken along line 11—11 of FIG. 9.

Turning to FIGS. 9–11, there is shown the agitation unit 60 in accordance with the present invention. Agitation unit 60 receives mixed chemical slurry or solution from the mixing apparatus 20 and further agitates the mixture to ensure even mixing of the bulk chemical prior to dispensing. Agitation unit 60 consists generally of a tank enclosure 62 having an associated inlet 65 and outlet 72. An angularly sloped V-shaped tank floor 67 is provided in association with tank enclosure 62 and is configured such that the nadir of the floor is centrally positioned and the floor has an upward slope towards its peripheral edges. An angled baffle 75 is centrally provided and vertically projects, substantially perpendicular, to the slope of the floor and divides the tank into inlet and outlet sides.

The tank inlet 65 conducts a fluid flow 69 from the mixing unit 20 into the inlet side of the tank enclosure 62. The tank outlet 72 conducts the fluid flow 69 from the outlet side of the tank to a point external to the enclosure 62. A fluid inlet flow 64 is conducted through inlet 65 and enters the inlet side of the tank enclosure 62 through an inlet port 66. In accordance with a preferred embodiment of the present invention, inlet port 66 is defined by the floor of the tank enclosure 62 and a recessed sloped floor panel 68 provided on the inlet side of the tank. The angled baffle 75 constrains the inlet flow 69 to the inlet side of the tank, conducts the flow 69 down the inlet slope of floor 67 and laterally displaces the flow 69 as it encounters the opposing upward slope 70 of the tank floor. Upon encountering the upward slope 70 of the tank floor and the corresponding side wall of the tank enclosure 62, the flow 69 overturns about the angled baffle 75 and flows to the opposing upward slope 67 of the tank floor. When the fluid flow 69 reaches the upward slope 67 of the tank floor, the outlet port 72, provided at the nadir of the sloped floor, captures the flow 69 and evacuates the flow 69 to a point external to the tank enclosure 62.

With the above-described agitation tank configuration, inlet flow 64 is introduced into inlet 65 as a laminar flow, is mechanically coerced into an overturning eddy flow within the tank enclosure 62, is captured by outlet port 72 and subsequently evacuated to a point external to the agitation unit 60. By creating the eddy flow within the tank enclosure 62, the chemical mixture is agitated sufficiently to permit full and complete mixing of the chemical prior to dispensing. To further facilitate mixing of the chemical, a shower or spray nozzle 76 is provided in association with the agitation baffle 75 to rinse the inner walls of the tank enclosure 62 to assure that particulate or residual chemical is fully rinsed.

Those skilled in the art will understand that a recirculation pump of appropriate capacity and construction along with fluid conduit and valving, as known in the art, may be provided in-line with the outlet 72 to redirect the outlet flow 69 back into the inlet 65 to recirculate the fluid into the agitation unit 60.

Figure 12:
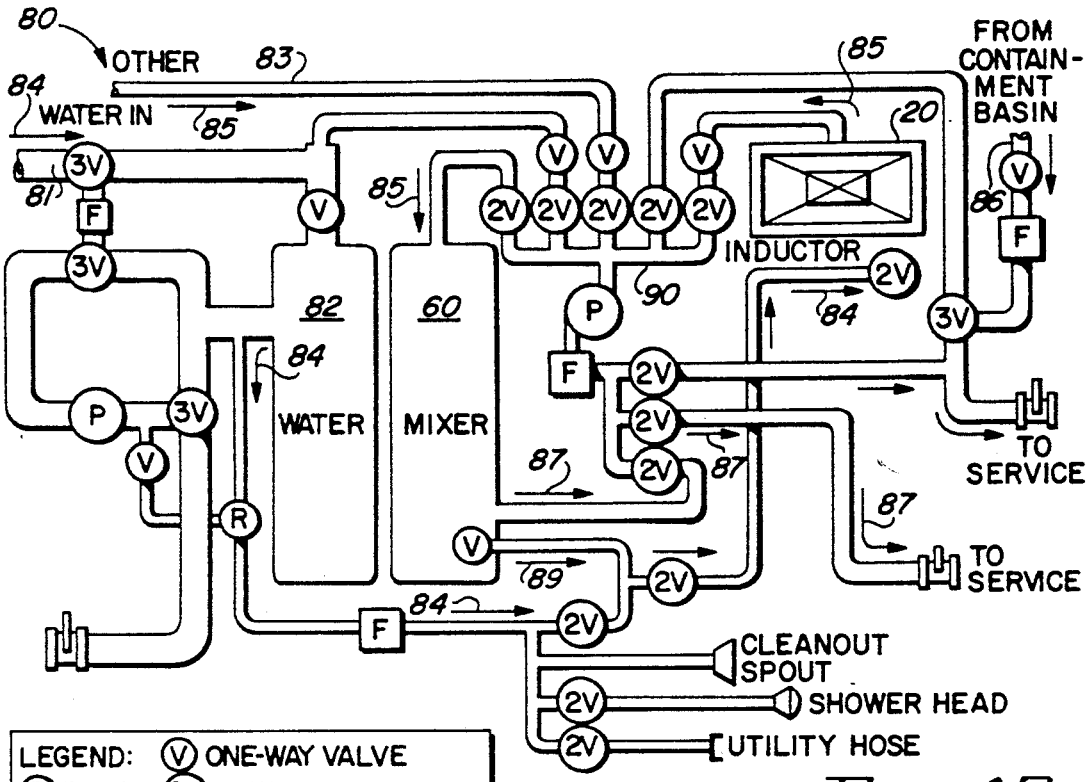
FIG. 12 is a diagrammatic view of a fluid handling system for a single induction and mixing unit chemical handling and mixing system of the present invention.
Figure 13:
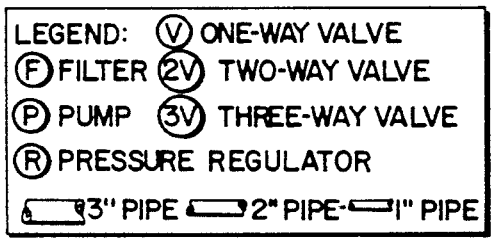
FIG. 13 is a diagrammatic view of a fluid handling system for a multiple induction and mixing unit chemical handling and mixing system according to the present invention.

Alternative preferred embodiments of the present invention are illustrated with reference to FIGS. 12–14, which diagrammatically set forth examples of preferred construction of a single induction unit 20 and single agitation unit 60 system (FIG. 12) and a multiple induction unit 20 and multiple agitation unit 60 system. Those skilled in the art will understand, from the accompanying Figures, that the basic fluid flow paths are fundamentally identical in the single 80 or multiple 100 unit systems, i.e., that a mixing fluid flow 81, such as water, is received from an external source through inlet conduit 81. The mixing fluid is conducted to a fluid tank 82, where it may be stored for transportation to a remote mixing site. During operation, a fluid flow 84 is withdrawn from the water tank 82, filtered, and conducted to the induction unit or units 20. The fluid flow 84 may, alternatively, be diverted to a plurality of external sources, e.g., a utility hose, or shower head, as illustrated.

Once introduced into the induction unit 20 or units 20, the fluid flow 84 becomes mixed with the bulk chemicals in the induction unit, and is exhausted from the induction unit or units 20 as a mixed chemical flow 85. Mixed chemical flow 85 is then conducted through a valve manifold 90, which, in turn conducts the mixed chemical flow 85 to the agitation unit 60. Valve manifold 90 is provided with a plurality of additional conduit and valving to receive other inputs from other sources, such as from a spill containment basin 86, or from another source 83, and add fluid received from the other sources to the mixed chemical flow 85 prior to communicating the resulting flow to the agitation unit 60.

After processing in the agitation unit 60, an agitated fluid flow 87 may be conducted externally to service, such as for loading into external tanks. The agitated fluid flow 87 may also be mixed directly with the fluid from the spill containment basin by actuating appropriate valving, as illustrated. Alternatively, a recirculation fluid flow 89 may be created by actuating an outlet valve associated with the agitation unit 60, as illustrated, to conduct a recirculating flow 89 back to the induction unit 20.

Figure 14:
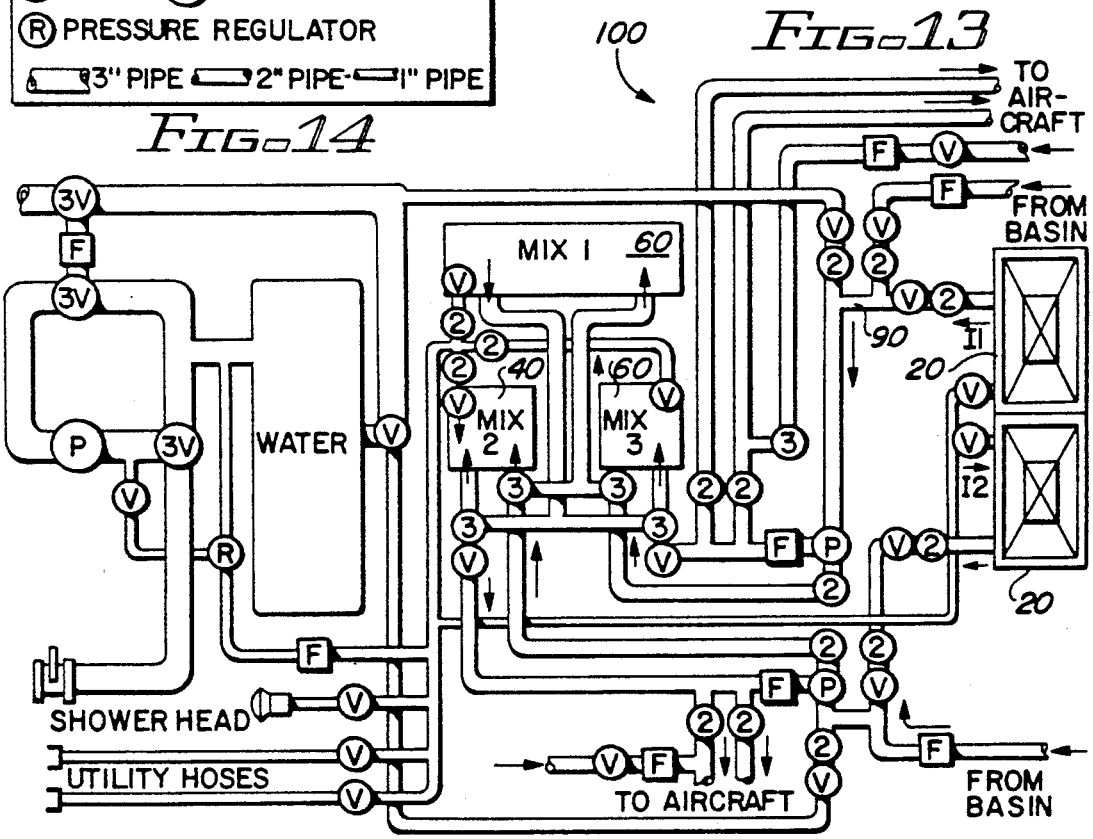
FIG. 14 is a legend for FIGS. 12 and 13.

The foregoing operational description of the single induction unit/single agitation unit system 80 is also applicable to the multiple induction/multiple agitation unit system 100 illustrated in FIG. 14. The principal difference between the two systems is the provision of additional valving to facilitate multiple inputs into the induction units 20 and agitation units 60, as well as the corresponding multiple outputs, as well as controls, as are known in the art, to permit user selection of single unit, or various combinations of multiple unit operation. Those skilled in the art will understand, however, from the accompanying FIGS. 12–14, that the specific selection of valve types, controls, conduits, and connections are well within the purview of one skilled in the art when taken with the foregoing operational description.

While the invention has been described with reference to certain preferred embodiments, those skilled in the art will recognize that modifications and variations may be made in construction and material without departing from the spirit and scope of the present invention, which is intended to be limited only by the scope of the claims appended hereto.

I claim:

1. Apparatus for mixing chemicals, comprising:

a tank having an inner wall and an outer wall defining an inter-wall space therebetween and a central interior opening, said interior opening further having an upper and lower chamber defined therein, said lower chamber terminating in a fluid outlet;

fluid introduction means for introducing a fluid flow into and through said inter-wall space of said mixing tank to the top corners of and into said upper chamber, comprising a service block member operably coupled to said tank, said service block member comprising a fluid inlet, fluid outlet communicating with said fluid outlet of said tank, an annular fluid channel and at least one fluid inlet tap in fluid flow communication with said inter-wall space of said tank;

a perforate member substantially subtending and dividing said interior opening into said upper and said lower chambers;

means for agitating the chemical mixing fluid, said means being in fluid flow communication with said fluid outlet of said mixing tank and dispensing an agitated fluid therefrom; and means for evacuating chemical vapors from said tank, comprising at least one tubular member disposed within said interwall space, passing through said inner wall of said tank and communicating with said lower chamber of said tank, and means for drawing a vacuum through said tubular member.

2. The apparatus according to claim 1, wherein said means for drawing a vacuum through said tubular member further comprises an annular vapor channel provided in said service block member, said annular vapor channel having at least one vapor tap communicating with said at least one tubular member, said annular vapor channel also communicating with said fluid outlet port of said service block member, whereby fluid passing out of said fluid outlet port creates a vacuum in said annular vapor channel.

3. An apparatus for mixing bulk materials with a fluid, comprising:

a material induction tank having an inner wall and an outer wall, fluid conduit interdisposed between said inner wall and said outer wall, a central mixing chamber, said mixing chamber being further separated into an upper and a lower chamber, said lower chamber terminating in an outlet, and flow restriction means for receiving a fluid flow from said fluid conduit, converting said fluid flow to a laminar fluid flow and directing said laminar fluid flow into said upper chamber of said tank;

a service member operably coupled to said material induction tank, said service member further comprising a fluid inlet, fluid outlet communicating with said fluid outlet of said tank, an annular fluid channel and at least one fluid inlet tap in fluid flow communication with said fluid conduit, whereby a mixing fluid is introduced into said fluid inlet, flows into and through said annular fluid channel and into and through said at least one fluid inlet tap, into said fluid conduit, through said flow restriction means and into said upper chamber of said tank;

a perforate member substantially subtending and dividing said interior opening into said upper and said lower chambers;

an agitation tank in fluid flow communication with said fluid outlet of said mixing tank; and means for evacuating chemical vapors from said tank, comprising at least one tubular member disposed within said interwall space, passing through said inner wall of said tank and communicating with said lower chamber of said tank, and means for drawing a vacuum through said tubular member.

4. The apparatus according to claim 3, wherein said means for drawing a vacuum through said tubular member further comprises an annular vapor channel provided in said service block member, said annular vapor channel having at least one vapor tap communicating with said at least one tubular member, said annular vapor channel also communicating with said fluid outlet port of said service block member, whereby fluid passing out of said fluid outlet port creates a vacuum in said annular vapor channel.

* * * * *